United States Patent [19]

Larking et al.

[11] Patent Number: 4,718,260

[45] Date of Patent: Jan. 12, 1988

[54] COMBINATION LOCK

[75] Inventors: Andrew R. Larking; Richard N. Swincer, both of 5 Wildwood Road, Happy Valley, South Australia 5159

[73] Assignees: Craig R. Bott; Andrew R. Larking; Richard N. Swincer, all of Australia

[21] Appl. No.: 768,484

[22] PCT Filed: Nov. 23, 1984

[86] PCT No.: PCT/AU84/00245

§ 371 Date: Jul. 24, 1985

§ 102(e) Date: Jul. 24, 1985

[87] PCT Pub. No.: WO85/02438

PCT Pub. Date: Jun. 6, 1985

[30] Foreign Application Priority Data

Nov. 25, 1983 [AU] Australia ..... PG2563

[51] Int. Cl.[4] ..... E05B 37/16

[52] U.S. Cl. ..... 70/299; 70/332; 70/445

[58] Field of Search ..... 70/297, 287, 299, 288, 70/300, 314, 214, 360, 315, 220, 361, 363, 298, 351, 387, 378, 392, 332, 445

[56] References Cited

U.S. PATENT DOCUMENTS

| | | | |
|---|---|---|---|
| 577,301 | 2/1897 | Heacock | 70/287 |
| 918,200 | 4/1909 | Roche | 70/299 |
| 1,352,890 | 9/1920 | Ganss . | |
| 2,143,419 | 1/1939 | Ladizinsky . | |
| 2,167,205 | 7/1939 | Heyer . | |
| 2,558,619 | 6/1951 | Lehman . | |
| 2,920,473 | 1/1960 | Hansen . | |
| 3,274,810 | 9/1966 | Traversa et al. . | |
| 3,961,506 | 6/1976 | Perez | 70/363 |
| 4,358,942 | 11/1982 | Mattson . | |

FOREIGN PATENT DOCUMENTS

| | | | |
|---|---|---|---|
| 8388 | 8/1922 | Australia . | |
| 66315 | 1/1948 | Denmark | 70/288 |
| 845500 | 5/1939 | France | 70/288 |
| 466937 | 6/1937 | United Kingdom | 70/288 |
| 376547 | 5/1973 | U.S.S.R. | 70/288 |
| 438767 | 1/1975 | U.S.S.R. | 70/299 |

OTHER PUBLICATIONS

Australian patent application Ser. No. 77,731/81 filed on Nov. 20, 1981 and published on May 27, 1982.

*Primary Examiner*—Robert L. Wolfe
*Assistant Examiner*—Lloyd A. Gall
*Attorney, Agent, or Firm*—Baker, Maxham & Jester

[57] ABSTRACT

A combination lock of the type having a hollow base (1) containing a central plunger (12) guided for both rotational and slidable movement therein, the base (11) having a plurality of base notches (26) selectively engageable by lock plungers (31) carried by the central plunger (12) for axial movement, each lock plunger (31) having a portion capable of being contained within a respective notch (26) to thereby inhibit rotation, each lock plunger (31) also having a notch (33) arranged, when correctly positioned, to permit rotation of the central plunger (12), and a selection knob (42) which is rotational and slidable with respect to the central plunger (12) and which has a push pin (43) operable to depress selected ones of the lock plungers (31), the central knob (42) obscuring the lock plungers (31) such that it is not apparent which of the lock plungers are the selected ones for a combination.

7 Claims, 7 Drawing Figures

COMBINATION LOCK

This invention relates to a combination lock of the same general type described in the specification which accompanied our (now abandoned, but published) Australian Patent Application No. 77731/81 dated the Nov. 20, 1981.

BACKGROUND OF THE INVENTION

1. Field of the Invention

In that said specification there was described a combination type lock having a hollow base containing a central plunger, bearing surfaces between the base and central plunger guiding the plunger both for rotational and slidable movement, an annulus carried by the base and having a plurality of notches in a peripheral edge, a plurality of lock plungers carried by the central plunger for movement relative thereto in an axial direction, each lock plunger having a portion of its surface capable of being contained within a respective annulus notch which thereby inhibits rotation of the central plunger, but each lock plunger also having a notch intermediate its ends arranged that, upon selective depression of the lock plungers from initial positions, all of the lock plunger notches lie in the same plane as the annulus such that the lock plungers cause to inhibit rotation of the central plunger, and means to reset the lock plungers to their initial position.

2. Description of the Prior Art

A data bank search revealed also U.S. Pat. No. 4,191,035 HATCH; U.K. Patent No. 1,530,861 STANDEN; and U.S. Pat. Nos. 3,937,046 WANG; 3,910,078 S-B MANUFACTURING CO. LTD.; 4,176,533 NORDENDALE; 4,274,272 WANG; 4,266,415 CLARKE; and U.K. patent Nos. 1,566,017 MILLIKEN and 1,503,526 DANILIN. Of these, the most pertinent appear to be HATCH and STANDEN, but in all prior art known to the applicants, the ends of the lock plungers were visible from the exterior of the lock, and although extremely difficult to pick, it is nevertheless still possible to pick such a lock, and this possibility increases with age as some of the lock plungers would appear more polished than others due to consistent use.

BRIEF SUMMARY OF THE INVENTION

The main object of this invention is to provide further improvements which will still further increase the difficulties of picking a combination lock of the type described, and in an embodiment of this invention a combination lock of the type generally described in that said specification is further characterised by a selection knob which extends over the lock plungers to obscure them, the selection knob being guided for rotational and axially slidable movement with respect to the central plunger, and having a push pin by which it can selectively depress the lock plungers.

More specifically, this invention consists of improvements in a combination type lock having a hollow base containing a central plunger guided for both rotational and slidable movement therein, a circular surface fixed with respect to the base and having a plurality of notches therein, a plurality of lock plungers carried by the central plunger for movement relative thereto in an axial direction, each said lock plunger having a portion of its surface capable of being contained within a respective said base notch to thereby inhibit rotation of the central plunger but each said lock plunger also having a notch, so arranged that there is a plane which, if all said plunger notches lie therein, the lock plungers cease to inhibit rotation, said improvements comprising a selection knob obscuring the lock plungers, means guiding the selection knob for rotational and axial slidable movement with respect to the central plunger, and a push pin carried by the selection knob operable to selectively depress said lock plungers.

It is important that the lock should not be readily breakable such that, by merely shearing the lock plungers, the central plunger becomes rotatable and thereby can operate a lock. In another embodment of this invention each of at least some of the lock plungers is provided with a pair of spaced notches, one of which extends to its inner end and is engageable with a cylindrical surface, each notch having a flat surface which divides the respective lock plunger into a semi-circular portion, and this arrangement maintains better strength than the arrangement which was described in our earlier said application.

BRIEF DESCRIPTION OF THE DRAWING

An embodiment of the invention is described hereunder in some detail with reference to, and is illustrated in, the accompanying drawings, in which.

DESCRIPTION OF THE PREFERRED EMBODIMENTS

Figure 2:
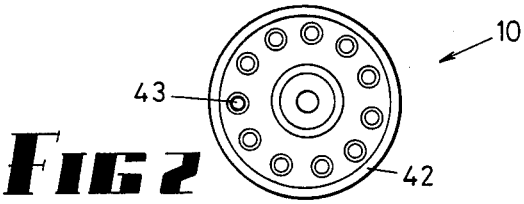
FIG. 2 is a section taken on line 2—2 of FIG. 1.
Figure 1:
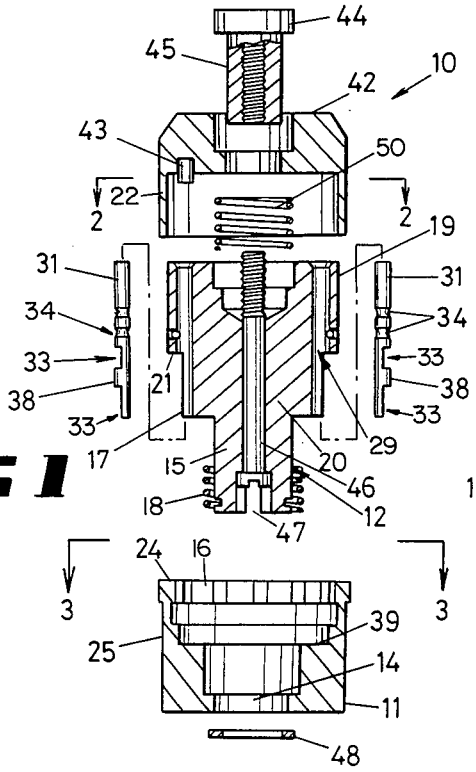
FIG. 1 is an "exploded" elevational section through a lock.

In this embodiment a combination lock 10 has a hollow cup-like base 11 with a central plunger 12 therein. The base 11 contains two internal plunger guide surfaces, the lower one 14 of which guides a stem 15 of the central plunger 12 and the upper one 16 of which guides an outer cylindrical surface 17 of the intermediate portion 20 of the central plunger 12. The central plunger 12 is movable within the base both for rotational movement and for sliding movement against base spring 18, but the uppermost portion of the central plunger 12 is a larger diameter portion 19 than intermediate portion 20 and between the uppermost portion 19 and the intermediate portion 20 is a shoulder 21 which, upon inward (reset) movement of the central plunger 12, abuts the upper and outer end of the cup-like base 11 to arrest such movement.

Figure 3:
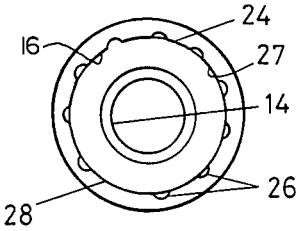
FIG. 3 is a plan view of base 11 taken on line 3—3 of FIG. 1.

The base 11 also has an inwardly directed annulus 24 which projects radially inwardly from its skirt 25, the annulus having a plurality of part-round notches 26 which extend radially outwardly from its inner peripheral edge 27, the base notches 26 being arranged to subdivide a pitch circle equally, except for one "blank" space (designated 28 in FIG. 3) where no notch exists.

A plurality of lock plungers 31 are carried in apertures 29 in the central plunger 12, the upper portions of the lock plungers being contained by aperture walls in the central plunger which are similarly arranged on a pitch circle except for the one blank space 28, so that when co-axially aligned, the apertures of the plunger can also be aligned with the half round notches 26 of the cup-like base 11.

Each of some of the lock plungers 31 within the central base is provided with a pair of plunger notches 33, the lower notch 33 extending to the inner end and having a flat surface which divides that lower end into a semi-circular portion (FIG. 7), and the other (upper) notch an intermediate notch outward of the lower notch, again dividing the plunger into another semi-circular portion, and each lock plunger 31 also has a pair of circular grooves 34 which selectively engage resilient means (a spring loaded ball 35) within the central plunger 12 so that each lock plunger can snap into one of two alternative positions.

Figure 5:
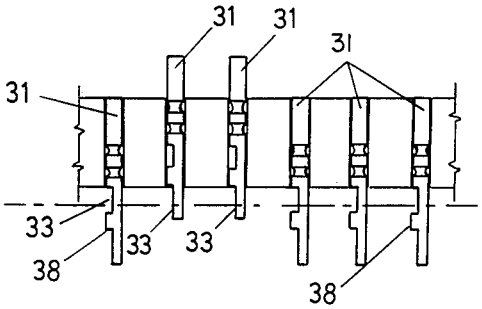
FIG. 5 is a diagrammatic "stretch-out" showing how the lock plunger notches can be selectively positioned to lie in a single plane which allows rotation of the central plunger.
Figure 6:
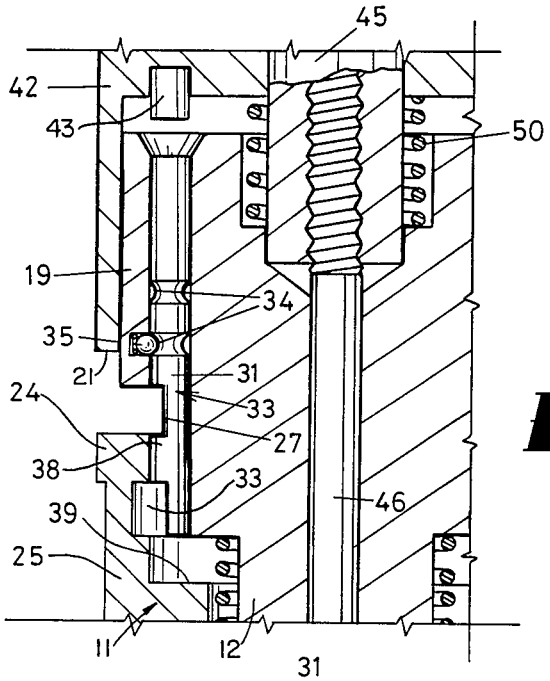
FIG. 6 is a fragmentary section corresponding to FIG. 4 but drawn to an enlarged scale.
Figure 7:
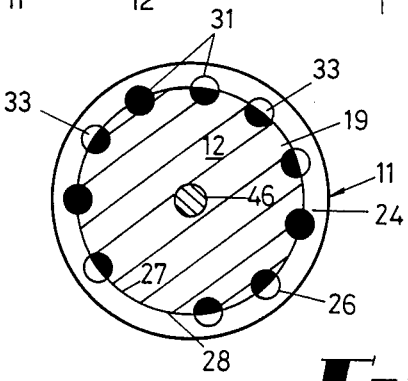
FIG. 7 is a section taken on line 7—7 of FIG. 4, to a larger scale, and showing how the lock plungers function to inhibit rotation.

The projection 38 which exists between the two notches 33 of each lock plunger 31 is arranged so that it can either be in the same plane as the base annulus 24, or between the base annulus 24 and a reset surface 39 which is co-axial with the annulus and has the same diameter, in such a way that the lock plunger can occupy only one position where its notches allow free rotational movement with respect to the annulus. However, some of the lock plungers 31, (as shown in FIG. 5), do not have projections, but are provided with one notch only, so that, if incorrectly depressed, they prohibit rotation of the central plunger. FIG. 7 illustrates three such conditions in the full black circles.

Figure 4:
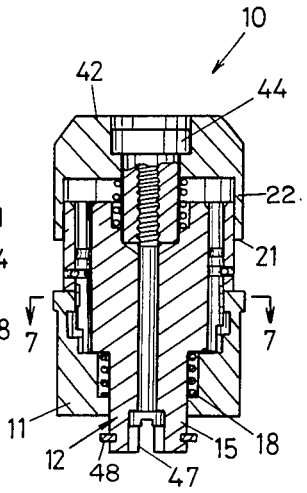
FIG. 4 is a section similar to FIG. 1, but showing the elements of the lock assembled with the central plunger depressed to a "reset" position.

There is provided a cup-like selection knob 42 having a skirt 22 surrounding larger diameter portion 19 of plunger 12, and also having with a push pin 43 depending from an inner flat surface, the push pin being selectively aligned with any one of the lock plungers 31 or positionable over the blank area. When positioned over the blank area depression of the selection knob urges the central plunger 12 inwardly against spring 18, whereupon the inner ends of lock plungers 31 abut the reset surface 39, returning the lock plungers 31 to an original position (FIG. 4). The selection knob 42 is retained for both its axial and rotational movement by the head 44 of a threaded stem 45 which contains a female thread engageable by an elongate screw threaded member 46 which fastens through the lock assembly. The lower end of the central plunger stem is bifurcate at 47, and this provides means for controlling the opening or closing of a lock catch, the surfaces defining the bifurcate portion 47 engaging the catch in a manner similar to that in common lock catches. There is also provided a "C" spring 48 contained within a groove in the lower end of the stem for retention of the central plunger to the cup-like base. A return spring 50 urges selector knob 42 axially outwardly.

In use, the selector knob is positioned above one of the lock plungers which needs to be pushed inwardly for its upper notch 33 to align with the base annulus 24. The selection knob is then pushed inwardly against spring 50, and its push pin pushes that lock plunger downwardly into the required position. Spring 50 will be fully depressed before spring 18 commences its compression. The selection knob is then released, and rotated to be positioned above another lock plunger, and this action is repeated three or four times. There can for example be 10 lock plungers (pins). When all the lock plungers are correctly positioned and the selection knob is aligned over any plunger that is depressed, the selection knob is able to be depressed engaging the inner cylinder and this in turn will allow the door to be opened by rotating the selection knob. However, depressing of any one of the "incorrect" lock plungers 31 will result in inhibition of rotation of the central plunger 12.

Thus, for example, to unlock a door with a combination (1,2,3), the following steps are taken:

1. Turn selection knob to zero (or blank) position and depress (to clear), compressing both the return spring 50 and the base spring 18 so that the lock plungers all move outwardly towards the knob.

2. Turn selection knob to position one (one click clockwise) and depress. (The "clicks" are felt as push pin 43 rides over the upper ends of respective apertures 29 in plunger 12, when selection knob 42 is pushed in for part only of its axial travel against spring 50, and then rotated.

3. Repeat over position two and three.

4. With selection knob depressed over pin three, so that push pin 43 engages a part round notch 26, turning the knob also turns the central plunger 12, and opens the door.

5. To re-lock turn selection knob to zero (or blank) and depress which resets all pins in outward position. This cannot be achieved unless selection knob is at zero, as the knob's pin will abut on the locking pins.

We claim:

1. In a combination type lock having a hollow base containing a central plunger, a reset surface on the base, a circular surface fixed with respect to the base and having a plurality of notches therein, a plurality of lock plungers carried by the central plunger for movement relative thereto in an axial direction, each said lock plunger having a portion capable of being contained within a respective said base notch to thereby inhibit rotation of the central plunger but each said lock plunger also having a notch, so arranged that there is a plane which, if all said plunger notches lie therein, the lock plungers cease to inhibit rotation, improvements whereby the lock plungers are equally spaced from one another on a pitch circle, except for one blank space, said central plunger being guided for both rotational and slidable movement in the hollow base, a selection knob obscuring the lock plungers, means guiding the selection knob for rotational and axial slidable movement with respect to the central plunger, and a push pin carried by the selection knob operable to selectively depress said lock plungers, but when located over said blank space, said push pin being operable to depress said central plunger together with said lock plungers, abutting the lock plungers against the reset surface, and thereby effect reset of the lock plungers in said central plunger.

2. Improvements in a combination type lock according to claim 1 wherein said circular surface is the inner peripheral surface of an inwardly directed annulus carried by the base.

3. Improvements in a combination type lock according to claim 1 or claim 2 wherein said selection knob is a cup-like member having a skirt which partly shrouds the central plunger.

4. Improvements in a combination type lock according to claim 3 wherein a push member comprises a pin carried by the cup-like member and directed inwardly, and positionable above each of the lock plungers and said blank space in turn upon rotation of the selection knob.

5. Improvements in a combination type lock according to claim 1 further comprising a knob return spring located between the selection knob and the central plunger.

6. Improvements in a combination type lock according to claim 5 further comprising a base spring between the central plunger and the base which is stiffer than the knob return spring.

7. Improvements in combination type lock according to claim 1 wherein the central plunger has a stem which extends through the base, and further comprising a headed stem which extends through the selection knob, the head of which constrains axial sliding movement of the selection knob, and a fastener extending through the central plunger releasably retaining the headed stem to the central plunger.

* * * * *